US008448353B2

(12) United States Patent
Seliger

(10) Patent No.: US 8,448,353 B2
(45) Date of Patent: May 28, 2013

(54) BOOT IN PARTICULAR SKI OR SNOWBOARD BOOT

(75) Inventor: Sven Seliger, Söll (AT)

(73) Assignee: Deeluxe Sportartikel Handels GmbH, Kufstein (AT)

( * ) Notice: Subject to any disclaimer, the term of this patent is extended or adjusted under 35 U.S.C. 154(b) by 737 days.

(21) Appl. No.: 12/523,219

(22) PCT Filed: Dec. 27, 2007

(86) PCT No.: PCT/EP2007/011435

§ 371 (c)(1),
(2), (4) Date: Mar. 8, 2010

(87) PCT Pub. No.: WO2008/086883

PCT Pub. Date: Jul. 24, 2008

(65) Prior Publication Data

US 2010/0175278 A1 Jul. 15, 2010

(30) Foreign Application Priority Data

Jan. 17, 2007 (DE) ..... 10 2007 002 367

(51) Int. Cl.
*A43B 5/04* (2006.01)

(52) U.S. Cl.
USPC ..... 36/50.1; 36/50.5

(58) Field of Classification Search
USPC ..... 36/50.1, 50.5, 117.1
See application file for complete search history.

(56) References Cited

U.S. PATENT DOCUMENTS

| | | | | |
|---|---|---|---|---|
| 7,281,341 | B2 | 10/2007 | Reagan et al. | |
| 7,409,781 | B2 * | 8/2008 | Azam et al. | 36/50.5 |
| 7,735,242 | B2 * | 6/2010 | Seliger et al. | 36/50.5 |
| 7,963,049 | B2 * | 6/2011 | Messmer | 36/117.6 |
| 2003/0034365 | A1 | 2/2003 | Azam et al. | |

(Continued)

FOREIGN PATENT DOCUMENTS

| | | |
|---|---|---|
| CH | 425538 | 11/1966 |
| EP | 1679014 | 7/2006 |
| FR | 2826557 | 1/2003 |
| WO | 0147386 | 7/2001 |

OTHER PUBLICATIONS

English translation of International Preliminary Report on Patentability (Chapter I) for PCT/EP2007/011435, Aug. 13, 2009, 7 pages.

(Continued)

*Primary Examiner* — Marie Patterson
(74) *Attorney, Agent, or Firm* — Michael Best & Friedrich LLP

(57) ABSTRACT

A boot includes a lacing system having an upper zone of action associated with an upper portion of the boot body and a lower zone of action associated with a lower portion of the boot body. The lacing system includes a single bootlace, the first end of which is anchored in the upper zone of action and the second end of which is anchored in the lower zone of action. The boot also includes a common lace-tightening device, having a handpiece, for the upper zone of action and the lower zone of action of the lacing system. The common lace-tightening device cooperates with the bootlace in such a way that, on operation of the handpiece, the upper zone of action and the lower zone of action of the lacing system are acted upon simultaneously in respect of lacing up and opening the boot.

11 Claims, 3 Drawing Sheets

U.S. PATENT DOCUMENTS

| | | | | |
|---|---|---|---|---|
| 2005/0126043 | A1* | 6/2005 | Reagan et al. | 36/50.5 |
| 2005/0166426 | A1* | 8/2005 | Donnadieu et al. | 36/50.5 |
| 2006/0070261 | A1* | 4/2006 | Reagan et al. | 36/50.5 |
| 2006/0075659 | A1 | 4/2006 | Reagan et al. | |
| 2006/0075660 | A1* | 4/2006 | Reagan et al. | 36/50.5 |
| 2006/0213085 | A1* | 9/2006 | Azam et al. | 36/50.5 |
| 2007/0130799 | A1 | 6/2007 | Seliger et al. | |
| 2007/0169377 | A1* | 7/2007 | Neiley | 36/50.5 |
| 2008/0168685 | A1* | 7/2008 | Kim et al. | 36/115 |
| 2010/0101114 | A1* | 4/2010 | Reagan et al. | 36/117.1 |

OTHER PUBLICATIONS

Search Report for PCT/EP2007/011435, dated Apr. 15, 2008, 6 pages.

* cited by examiner

BOOT IN PARTICULAR SKI OR SNOWBOARD BOOT

RELATED APPLICATIONS

This is a national phase application under 35 U.S.C. §371 of International Patent Application No. PCT/EP2007/011435 filed on Dec. 27, 2007, which claims priority to German Patent Application No. 10 2007 002 367.9 filed on Jan. 17, 2007, the entire contents of both of which are incorporated herein by reference.

BACKGROUND OF THE INVENTION

The present invention relates to a boot, especially a ski boot or snowboard boot.

Such boots are known in principle from the prior art and are used especially in various fields of sport, for example in mountain climbing, skiing and snowboarding, it being important in the first instance that in use the boot ensures secure support, especially in the foot region, without the boot's cutting into the bend of the foot. Furthermore, the boot should sit sufficiently firmly in the region of the shin in order to transfer the force of the user, especially in the case of skiing or snowboarding, to the sports equipment in question in the best possible way.

In addition to the firm support which a boot should offer, it is desirable that it should be capable of being laced up in such a way that the user can easily put on and take off the boot with relatively little effort. In the case of ski boots or snowboard boots, that requirement relating to the lacing system of the boot is of particular importance, because the boot is generally covered in ice after use, with the result that the lacing system can often be loosened only with considerable effort.

DE 20 2004 019 082 U1, for example, discloses a boot of the kind mentioned at the beginning, the lacing system of that boot consisting of two bootlaces. One bootlace is used for lacing up the boot in the leg region, whereas the other bootlace is provided for lacing up the foot region. For that purpose, the bootlace associated with the foot region is attached to the boot by one end. In the foot region, the bootlace is guided through three redirection elements which are each mounted to the side of the boot tongue. After the third redirection element, the free end of the lower bootlace is guided upwards along the leg of the boot, where the lace ends in a handgrip.

The upper bootlace associated with the leg of the boot is joined to the boot and guided in the boot in an analogous way.

In the solution known from the prior art, the two bootlaces are operable independently of one another, so that a first upper lacing zone in the region of the leg of the boot can be tightened or loosened independently of a second lower lacing zone in the region of the foot portion of the boot. As a result of the two separate lacing zones in the leg and foot regions of the boot, at least in some areas there is no lacing acting on the transition region between the two zones, that is to say in the region of the bend of the foot.

There is therefore a risk that insufficient tension will be built up in the region of the bend of the foot so that the secure support in the boot is impaired. In addition, it has been found that to remove the boot it is necessary to loosen both the upper and the lower zones. Because the two lacings act independently of one another, it is not sufficient merely to slacken the upper lacing zone, because the foot is held firmly by the lower lacing, and it is not possible to step out of the boot easily.

SUMMARY OF THE INVENTION

On the basis of that problem, the aim of the invention is to develop a boot of the kind mentioned at the beginning in such a way that the boot is as simple as possible to put on and take off. Furthermore, the boot is to be provided with a lacing system which, in addition to offering greater ease of manipulation when the boot is being put on or taken off, offers secure support to the foot in the boot as whole.

That aim is achieved according to the invention on the one hand by the boot's lacing system having a single bootlace, the first end of which is anchored in the upper region of the upper zone of action and the second end of which is anchored at the boot-toe end of the lower zone of action, and on the other hand by the boot's lacing system having a common lace-tightening device, having a handpiece, for the upper zone of action and the lower zone of action, which cooperates with the bootlace in such a way that, on operation of the handpiece, the upper zone of action and the lower zone of action of the lacing system are acted upon simultaneously in respect of lacing up and opening the boot.

An important aspect of the invention is, therefore, that the boot comprises a lacing system having a single bootlace, the lacing system having a total of two main zones of action, namely an upper zone of action, which is associated with the upper portion of the boot body, i.e. with the leg of the boot, and a lower zone of action, which is associated with the lower portion of the boot body. In respect of lacing up and opening the boot, the upper zone of action has a direct operative and functional connection to the lower zone of action by way of the common lace-tightening device. Unlike the known boot, therefore, the boot according to the invention does not have two separate bootlaces, but has a single bootlace which can be either tightened or slackened using the handpiece of the lace-tightening device, this having a direct effect on the two zones of action of the lacing system.

The functionally connected zones of action have the result that loosening of the upper zone of action brings about the slackening of the single bootlace also in the region of the lower zone of action, so that slackening the lacing by means of appropriate operation of the common handpiece loosens both zones of action, and this, in particular, makes it extremely easy to take off the boot.

The upper zone of action and the lower zone of action each comprise a plurality of lace-redirection elements, the common lace-tightening device for the two zones of action being arranged between a lace-redirection element of the upper zone of action and a lace-redirection element of the lower zone of action. Such an arrangement of the lace-tightening device having the handpiece allows especially efficient transfer of force from the handpiece, i.e. from the lace-tightening device, to the boot lacing of the upper and lower zones of action, because the transmission of force is effected by way of the respective lace-redirection elements in both directions of the lacing. That has the result, in particular, that the lacing in the upper and lower zones of action can be tightened at the same time by the application of relatively little force.

In one construction of the last-mentioned embodiment, in which both the upper zone of action and the lower zone of action of the lacing system each have a plurality of lace-redirection elements, the lower zone of action has at least the same number of lace-redirection elements as the upper zone of action. If the number of lace-redirection elements is identical for both zones of action, a tightening of the lacing exerted on the bootlace by means of the lace-tightening device acts in the same way in the upper and in the lower zone of action of the lacing system. If, however, the number of lace-redirection elements in the lower zone of action is higher than the corresponding number in the upper zone of action, it is possible for a force exerted on the bootlace by the lace-tightening device to be transmitted unevenly in the two directions of the lacings. In particular, on application of the same amount of force, for example, the lacing in the upper zone of action of the lacing system is then subjected to greater tightening than is the lacing in the lower zone of action. Analogously, the lacing in the upper zone of action is also subjected to gentler slackening in comparison with the lacing in the lower zone of action when the bootlace is released by means of the handpiece. Accordingly, the respective action of a force exerted on the bootlace by the lace-tightening device on the upper and lower zones of action can be determined in advance by a suitable choice of the number of lace-redirection elements provided in each of those zones of action.

It has proved to be particularly advantageous for the lacing system also to have a lace guide, provided in or on the boot body, with which a portion of the bootlace that is in the form of an extended loop which is manipulable for opening and closing the boot by means of the common handpiece is guided from the region between the upper and lower zones of action towards the handpiece and back to the boot again. The use of such lace guides has the advantage that the extended loop which is manipulable for opening and closing the boot is guided securely and, especially, along a predictable path and does not get in the way when the boot is in use. In particular, when the boot is in use the lace loop is in that way prevented from becoming entangled with objects, for example with branches etc., during snowboarding or skiing. It will be seen that the portion of the bootlace that is in the form of an extended loop which is manipulable for opening and closing the boot by means of the common handpiece is the component of the lace-tightening device by means of which a force can be exerted on the bootlace by the lace-tightening device or by the handpiece of the lace-tightening device in order to adjust the respective lacings in the upper and lower zones of action accordingly.

In one construction of the lace guide, the latter has at least two tubes which are arranged in or on the boot body and through each of which one of the two loop-forming extended portions of the lacing system is guided. It will be understood, however, that other solutions also come into consideration for the lace guide.

It is particularly advantageous if the handpiece of the lace-tightening device can be used to exert force on a portion of the bootlace that is in the form of an extended loop, that portion of the bootlace being operable for opening and closing the boot and for adjusting the lacing in the upper and lower zones of action of the lacing system with the aid of the handpiece of the lace-tightening device. That means that the loop of the bootlace provided in the region of a redirection element does not make contact with a redirection element but is extended to the extent that the extended loop can be manipulated for opening and closing the boot.

For tightening the lacing, the loop can be lockable, which is achieved by the two loop-forming extended portions of the bootlace each being guided through a lace lock which is arranged on the boot body, especially on the leg of the boot, and is manually releasable. Because the extended loop is not guided around a redirection element but is extended, a redirection element can be omitted in the region of the extended loop. That embodiment offers a particularly simple way of implementing the lace-tightening device. Moreover, in such an embodiment the introduction of force from the handpiece of the lace-tightening device to the remainder of the bootlace is especially effective, because the force is conveyed from the extended loop directly to the portions of the lace guided around the adjacent redirection elements.

In order that the lacing system of the boot according to the invention offers particularly secure support in the boot as a whole, in one construction of the boot, the bootlace of the lacing system is guided in such a way that the bootlace crosses over itself at least once in the region between the upper zone of action and the lower zone of action. As a result of the provision of a single bootlace, which crosses over itself in the transition region between the upper and the lower zones of action, there is formed in the region of the bend of the foot, that is to say in the transition region between the upper and lower zones of action, a middle zone of action, with which the tension built up when the boot is laced up is sufficient to ensure that the foot is securely supported in the boot and especially in the region of the bend of the foot. In other words, this means that in this development the lacing system comprises a total of three zones of action, because as a result of the crossed-over arrangement of the bootlace a further, transition zone, that is to say a middle zone of action, is formed in addition to the upper zone of action and the lower zone of action. Those zones of action have a direct functional connection to one another, the middle zone of action, as a result of its having a functional connection to the two adjacent zones, acting as a tension-equalizing zone, which also has the result that the lacing of the boot is tightened as uniformly as possible. As a consequence, both wearing comfort and secure support in the boot are improved.

In addition or as an alternative thereto, it is possible for at least one cut-out, e.g., a U-shaped or V-shaped cutout, to be provided in the material of the boot between the upper portion of the boot body, in which the upper zone of action of the lacing system is located, and the lower portion of the boot body, in which the lower zone of action of the lacing system is located, that is to say in the transition region between the upper and the lower zones of action. Similarly to the middle zone of action, which is formed between the upper and the lower zones of action by the crossed-over arrangement of the bootlace, the at least one cut-out provided in the boot material between the upper portion of the boot body and the lower portion of the boot body acts as a tension-equalizing zone, with the result not only that, on the one hand, the lacing of the boot is tightened especially uniformly in all zones of action of the lacing system but also that, on the other hand, the wearing comfort of the boot and ease of manipulation of the boot, especially during putting on and taking off, are improved.

Comfort during putting on and taking off, that is to say during operation of the common handpiece, is further increased by the lace-tightening device's having a handpiece, especially in the form of a handgrip, through which the loop of the bootlace is freely guided, which loop is acted upon by the handpiece for opening and closing the boot.

As already mentioned, in one embodiment of the boot according to the invention the two loop-forming extended portions of the bootlace are each guided through a lace lock which is arranged on the boot body, especially on the leg of the boot, and is manually releasable. The lace lock may be a lockable lace-tightening device. It will be seen that this lockable lace-tightening device is associated simultaneously with both the upper and the lower zones of action. With the aid of the lace-tightening device, which is associated with the two zones of action, it is advantageously possible for the tension in the forefoot and in the leg to be adjusted simultaneously. The lace-tightening device allows, in particular, a progressive build-up of pressure in the boot, without the need for elaborate lacing in order, as in conventional boots, to tighten the lace first in the region of the forefoot and then in the region of the leg. In one embodiment of the boot 1, there is provided between the upper and lower zones of action a middle zone of action (e.g., a tension-equalizing zone), with which a distribution of pressure in the sensitive bending region of the foot is achieved so that the boot is prevented from cutting into the region of the bend of the foot. In terms of comfort when the boot is being put on and taken off, such an embodiment makes it possible, by loosening of the lace-tightening device associated with the two zones of action, to loosen the lacing as a whole by means of a single hand movement, because the upper zone of action has a direct operative and functional connection to the lower zone of action (and optionally to the middle zone of action). Loosening of the lacing in the region of the upper or lower zone of action is therefore continued into the middle zone of action and the lower or upper zone of action, respectively.

The locking of the bootlace with the aid of the lace lock, which may be manually releasable, also enables the lacing in the upper and lower regions of action to be fixed individually.

In order that putting on and taking off the boot is made as simple as possible, as an alternative or in addition to the lacing system according to the invention mentioned above the boot may also have a boot tongue which extends at least over the region of the boot body covered by the lacing system and which has, at the boot-leg end, a pull tab or a pull tape for quick opening of the boot.

As an alternative or in addition thereto it would also be conceivable, however, for the boot also to have an inner boot inserted or insertable into the boot body, having a pull tab arranged at the boot-leg end of the inner boot or a pull tape arranged at the boot-leg end of the inner boot for quick opening of the boot.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
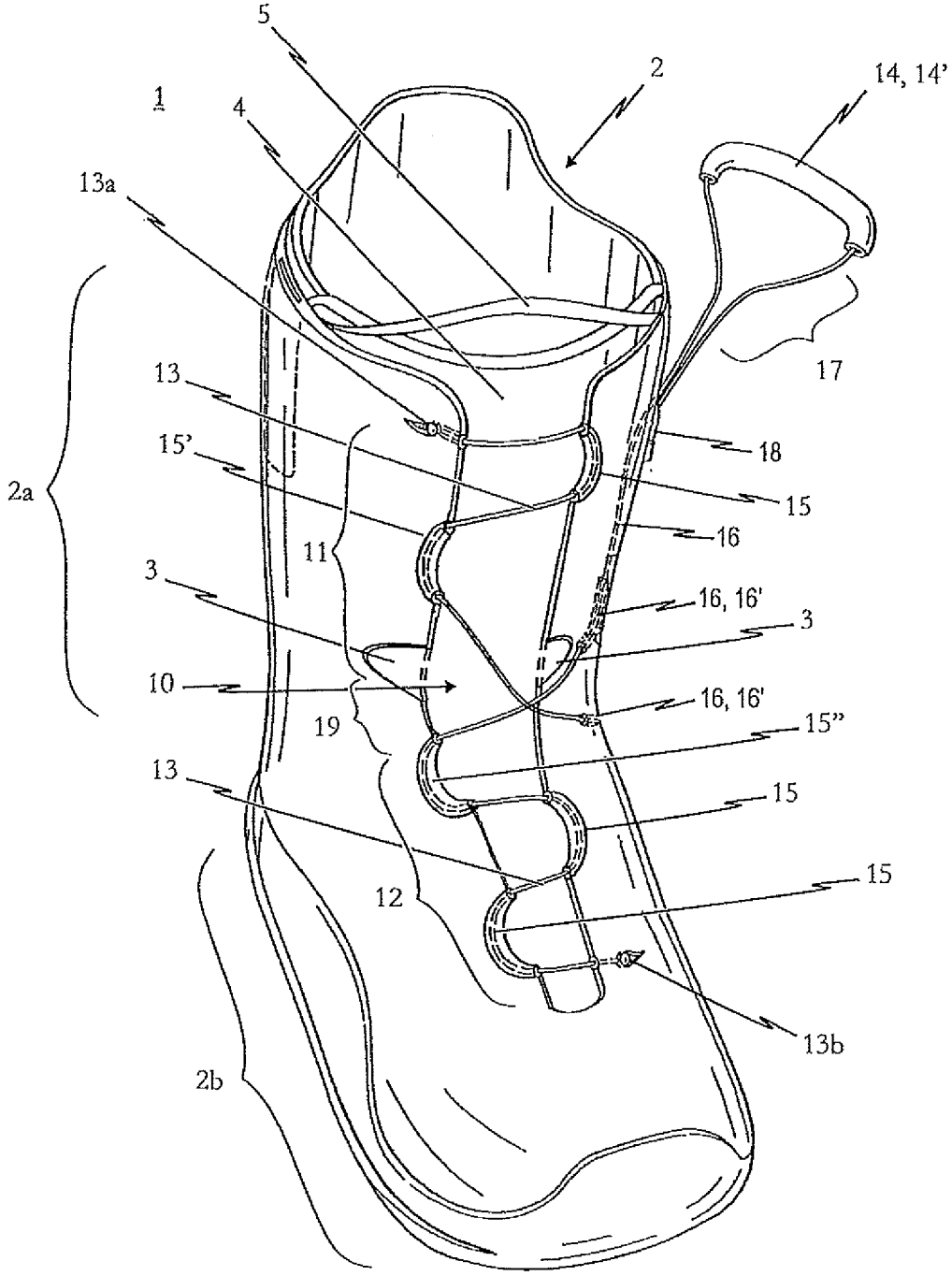
FIG. 1 is a perspective view of a boot according to the invention.
Figure 2:
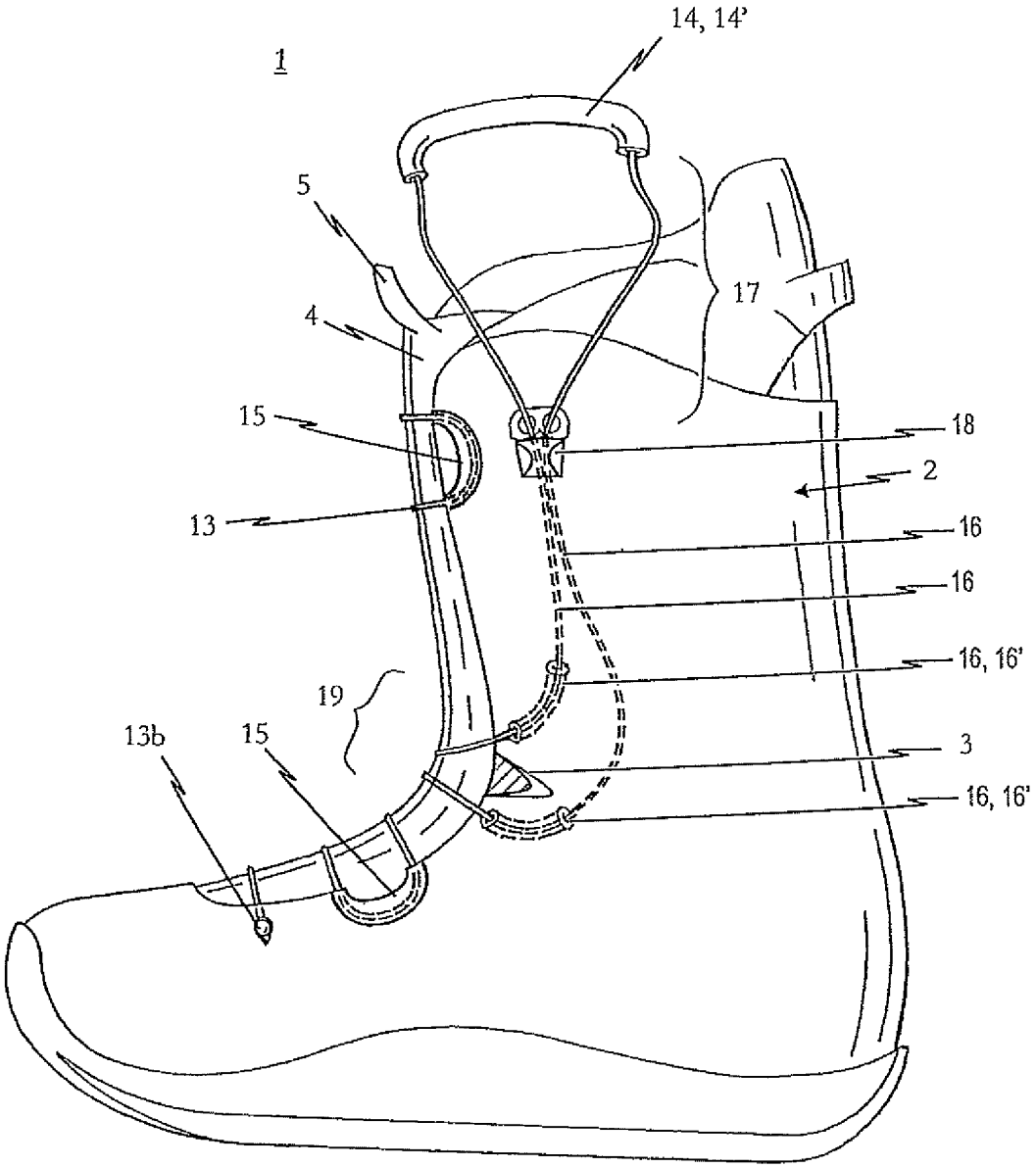
FIG. 2 is a side view of the boot according to FIG. 1.

FIG. 1 shows, in a perspective view, a an embodiment of the boot according to the invention, while FIG. 2 shows a side view of that boot. As shown, the boot 1 according to the invention has a boot body 2 which comprises an upper portion 2*a* for at least partially covering a wearer's shin and a lower portion 2*b* for covering the wearer's foot. Also provided is a lacing system 10 which comprises an upper zone of action 11 associated with the upper portion 2*a* of the boot body 2 and a lower zone of action 12 associated with the lower portion 2*b* of the boot body 2. The lacing system 10 is composed of a single bootlace 13, the first end 13*a* of which is anchored in the upper region of the upper zone of action 11 and the second end 13*b* of which is anchored at the boot-toe end of the lower zone of action 12. Furthermore, a common lace-tightening device 14, having a handpiece 14', for the upper zone of action 11 and the lower zone of action 12 of the lacing system 10 is provided, which cooperates with the bootlace 13 in such a way that, on operation of the handpiece 14', the upper zone of action 11 and the lower zone of action 12 of the lacing system 10 are acted upon simultaneously in respect of lacing up and opening the boot.

The mode of operation of the lacing system 10, and especially the effect of the operation of the handpiece 14' of the lace-tightening device 14 on the lacing in the different zones of action 11, 12 of the lacing system 10, is described in detail below with reference to FIG. 3.

It can also be seen from FIGS. 1 and 2 that in the boot 1 according to the invention the single bootlace 13 is guided in such a way that the bootlace 13 crosses over itself once in the region between the upper zone of action 11 and the lower zone of action 12. That region 19 located between the upper and lower zones of action 11, 12 defines a middle zone of action which acts as a tension-equalizing zone, so that overall a uniform pressure distribution is built up in the boot 1.

In particular, as a result of the middle zone of action 19 (i.e., the tension-equalizing zone), a distribution of pressure can be achieved in the sensitive bending region of the foot, so that the boot 1 is prevented from cutting into the region of the bend of the foot.

In the transition region between the upper portion 2*a* of the boot body 2, in which the upper zone of action 11 is located, and the lower portion 2*b* of the boot body 2, in which the lower zone of action 12 is located, advantageously a U-shaped or V-shaped cutout 3 is provided in the material, especially in the outer material, of the boot body 2 on each side of the boot tongue 4. By means of such a cutout 3 on each side of the edge portion of the boot body 2 defining the tongue region, an even better distribution of pressure is achieved in the sensitive bending region, this simultaneously having a facilitating action during putting on and taking off the boot.

It should be noted in respect of the handpiece 14' of the lace-tightening device 14 that in the illustrated embodiment of the present invention it comprises a handgrip through which, as can be seen particularly well in FIG. 2, a loop 17 of the bootlace 13 is freely guided. That loop 17 of the bootlace 13 is a portion of the bootlace 13 that is in the form of an extended loop which is especially operable for opening and closing the boot 1 with the handpiece 14. By means of the portion 17 lying free of the boot body 2, the lacing in the upper zone of action 11 and the lower zone of action 12 of the lacing system 10 is adjusted with the lace-tightening device 14 or the handpiece 14'.

The individual portions of the loop 17 are guided from the region 19 between the upper zone of action 11 and the lower zone of action 12 to the handpiece 14 and back again with the aid of a lace guide 16 which has guide tubes 16'.

It can be seen particularly well in FIG. 2 that in the embodiment described the two loop-forming extended portions 17 of the bootlace 13 are each guided through a lace lock 18 which is arranged on the boot body 2 and is manually releasable.

In order to make putting on and taking off the boot 1 as simple as possible, in the embodiment shown in FIG. 1 and FIG. 2, in addition to the lacing system 10 mentioned above, the boot 1 also has a boot tongue 4 which extends at least over the region of the boot body 2 covered by the lacing system 10, and which has at the boot-leg end a pull tab or a pull tape 5 for quick opening of the boot 1. As already mentioned, however, it is also conceivable for the boot 1 to include an inner boot inserted or insertable into the boot body 2, the inner boot comprising a pull tab or a pull tape at the boot-leg end.

The boot 1 having the lacing system 10 shown in FIG. 1 and FIG. 2 can especially be configured, for example, as a mountain boot or as a soft boot for a snowboard, the use of the lacing or the lacing system 10 for a snowboard boot being especially advantageous.

Figure 3:
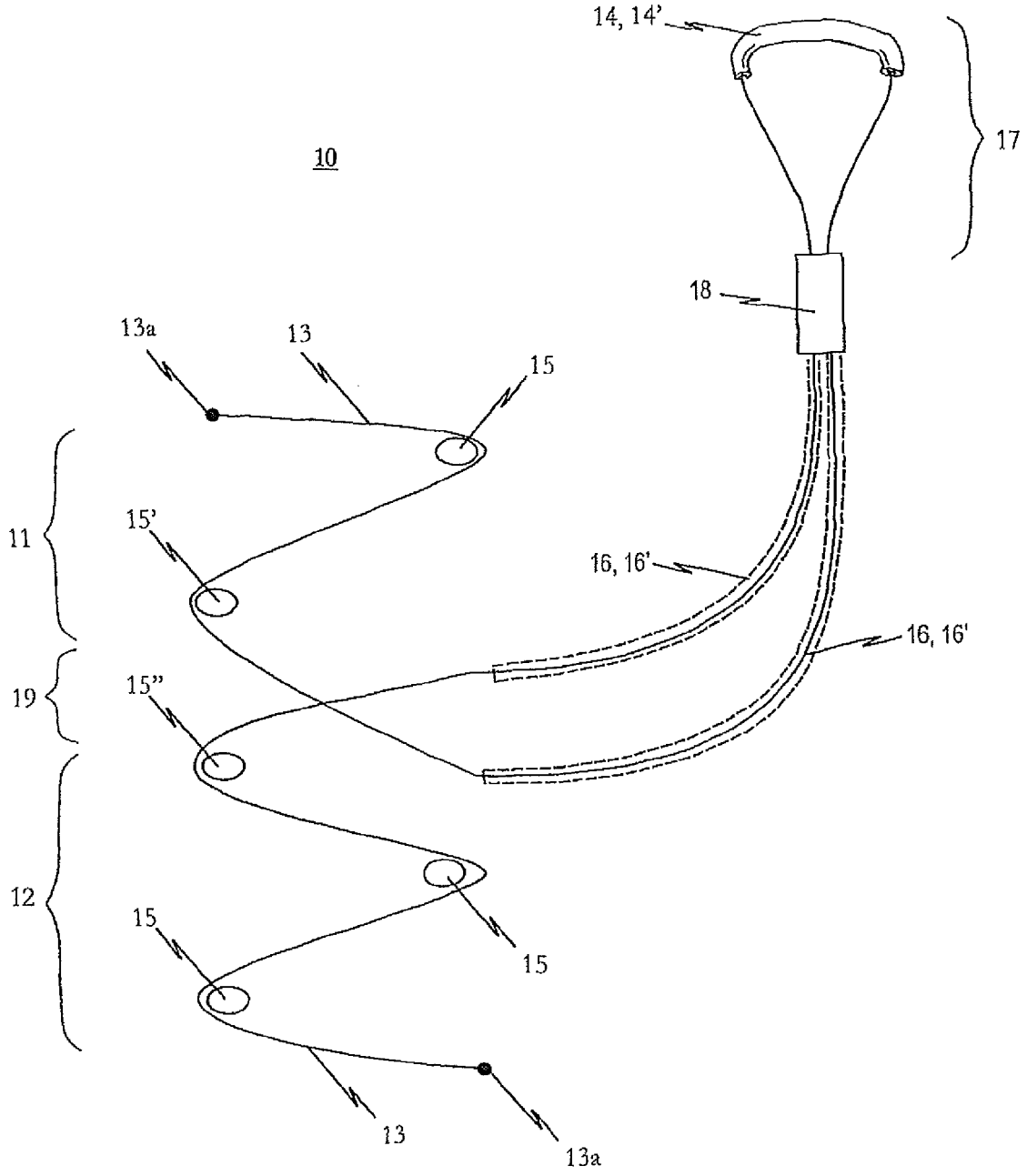
FIG. 3 is a diagrammatic view of the configuration of the lacing system of the boot according to FIG. 1 and FIG. 2.

For the sake of clarity, FIG. 3 shows, in a diagrammatic view, only the lacing system 10 and not the entire boot 1 in order better to explain the mode of operation of the lacing system 10. The lacing system 10 can be used in the boot 1 in accordance with the exemplary embodiment of the invention according to FIG. 1 or FIG. 2.

Unlike the lacing known, for example, from DE 20 2004 019 082 U1, the lacing system 10 of the boot 1 according to the invention comprises a single continuous bootlace 13. The lacing system 10, in the illustrated embodiment shown in FIG. 3, furthermore comprises two main zones of action—the upper and lower zones of action 11, 12—and a middle zone of action 19 which is produced by the crossed-over arrangement of the bootlace 13 in the transition region between the upper and lower zones of action 11, 12.

The upper zone of action 11 is located in the region of the leg of the boot, that is to say in the upper portion 2*a* of the boot body 2, while the lower zone of action 12 is arranged in the region of the forefoot, that is to say in the region of the lower portion 2*b* of the boot body. The middle zone of action 19 is arranged between the upper and lower zones of action 11, 12 and acts in the bending region of the boot 1. The middle zone of action 19 has a direct operative and functional connection to the upper and lower zones of action 11, 12 and acts as a tension-equalizing zone. As a result, a distribution of tension is achieved in the bending region, because tension established in the upper and lower zones of action 11, 12 is transmitted at least partially to the middle zone of action 19.

Moreover, the lacing system 10 shown in the drawings and especially in FIG. 3 enables the lacing tightness in the upper and lower zones of action 11, 12 to be adjusted individually, because both zones are simultaneously functionally connected with the aid of the lace-tightening device 14 or the handpiece 14' of the lace-tightening device 14 in respect of tightening and in respect of loosening of the lacing. To adjust the lacing tightness of the upper zone of action 11 and the lower zone of action 12 (and accordingly also the middle zone of action 19), the common lace-tightening device 14 having the handpiece 14' is associated with all zones of action 11, 12, 19, the lace-tightening device acting as a lockable lace-tightening device in the illustrated embodiment.

By operation of the lace-tightening device 14 or the handpiece 14', the upper and lower zones of action 11, 12 are tightened simultaneously, the lacing tightness established being maintained by locking the lace-tightening device with the aid of the lace lock 18.

In the example shown, the lace-tightening device 14 is in the form of an extended loop 17 which is manipulable for opening and closing the boot 1. For that purpose, the portions of the lace coming from the redirection elements 15', 15" arranged on one side of the boot tongue are not, as is customary, guided by way of a redirection element arranged on the opposite side of the tongue. Instead, that redirection element is omitted and the two portions of the lace are extended in such a way that they form a loop 17 that can be manipulated by the user of the boot, the lace portions being extended to such an extent that they can be guided through a lace lock 18 arranged in the region of the upper end of the leg, the free end of the lace loop 17 projecting beyond the lace lock 18 to such an extent that it can easily be grasped by the user. In practice, the length of the free end of the lace loop 17 projecting beyond the lace lock constitutes at least the leg height of the boot 1.

To prevent the extended portions 17 of the lace from becoming entangled or caught up or to prevent them from becoming intertwined, they are arranged in a guide 16 which is provided in or on the boot body 2. The guide 16 comprises flexible guide tubes 16' which are incorporated into the boot material or attached to the boot material. A tongue-side end of the guide tubes 16' is in each case arranged between or at about the same height as the redirection elements 15', 15" of the lower and upper zones of action 11, 12, respectively. The two tongue-side ends of the tubes 16' are spaced apart from one another and arranged relative to the redirection elements 15', 15" in such a way that the bootlace portions run into the tubes 16' at an angle which can be so selected that, on the one hand, the lacing angle of the bootlace 13 is uniform over the entire lacing and, on the other hand, in the transition region 19 between the upper zone of action 11 and the lower zone of action 12 the bootlace 13 crosses over itself and accordingly forms a tension-equalizing zone at that location.

Below the lace lock 18, the two lace portions pass out of the guide 16 and into the lace lock 18, with the result that only a very short portion of the lace lies freely on the boot body 2, so that the lace 13 is effectively prevented from becoming caught.

The free end of the lace 13 passes through the handgrip of the handpiece 14' which is freely movable along the lace loop 17, which handgrip facilitates easy tightening of the lace loop 17 or the lacing.

The two ends of the continuous bootlace 13 are attached respectively in the region of the leg of the boot 1 and in the lower region of the forefoot.

Instead of the two redirection elements 15 in the upper zone of action 11 and three redirection elements 15 in the lower zone of action 12, as shown in FIGS. 1-3, it is also possible for a different number of redirection elements to be selected. For example, four or six redirection elements can be provided, it not being absolutely necessary to provide the extended lace loop 17 between two immediately adjacent or consecutive redirection elements 15', 15". Instead, further redirection elements can be provided between the two lace portions of the lace loop 17.

For lacing up or loosening the boot 1, the lacing shown in the FIGS. 1-3 is operated as follows: by pulling on the lace loop associated with the upper zone of action 11, the lacing in that region is tightened, so that the lacing tightness of the boot can be adjusted. As a result of the functional cooperation of the upper and lower zones of action 11, 12, lacing tightness is achieved simultaneously in the region of the forefoot. Because the middle zone of action 19 has a direct functional connection to the upper and lower zones of action 11, 12, an equalization of tension between the upper and lower zones of action 11, 12 takes place up to a certain extent. By virtue of the equalization of tension by way of the middle zone of action 19, the bending region of the boot 1 is also acted upon by a certain degree of tension, so that the foot is securely supported also in the bending region, without the boot's cutting into the sensitive bend of the foot.

For stepping out of the boot 1 it is sufficient to loosen the common lace lock 18 associated with the upper and lower zones of action 11, 12, because the lacing in the upper and lower zones of action 11, 12 is slackened simultaneously as a result.

The invention is not limited to the embodiment of the boot 1 shown in FIGS. 1-3. Rather, any combination of the individual features of the boot 1 disclosed in this specification is conceivable.

Various features of the invention are set forth in the following claims.

The invention claimed is:

1. A boot including boot body having an upper portion for at least partially covering a wearer's shin and a lower portion for covering the wearer's foot, and having a lacing system with at least an upper zone of action associated with the upper portion of the boot body and a lower zone of action associated with the lower portion of the boot body, the boot comprising:

a single bootlace, the first end of which is anchored in the upper region of the upper zone of action and the second end of which is anchored at the boot-toe end of the lower zone of action; and a common lace-tightening device having a handpiece for the upper zone of action and the lower zone of action of the lacing system, wherein the handpiece cooperates with the bootlace in such a way that, on operation of the handpiece, the upper zone of action and the lower zone of action of the lacing system are arranged to be acted upon simultaneously in respect of lacing up and opening the boot, wherein the upper zone of action and the lower zone of action each include a plurality of lace-redirection elements, wherein the bootlace is guided by the plurality of lace-redirection elements in such a way that the bootlace crosses over itself at least once in a region between the upper zone of action and the lower zone of action.

2. The boot as set forth in claim 1, wherein the lace-tightening device is arranged between a first of the lace-redirection elements in the upper zone of action and a second of the lace-redirection elements in the lower zone of action.

3. The boot as set forth in claim 2, wherein the lower zone of action includes at least as many lace-redirection elements as the upper zone of action.

4. The boot as set forth in claim 1, wherein the lacing system includes a lace guide coupled to the boot body, and wherein a portion of the bootlace that is in the form of an extended loop that is manipulable for opening and closing the boot is guided by the lace guide from the region between the upper zone of action and the lower zone of action to the handpiece and back again.

5. The boot as set forth in claim 4, wherein the lace guide includes at least two tubes, and wherein the bootlace is guided through the respective tubes.

6. The boot as set forth in claim 5, wherein each of the loop-forming extended portions of the bootlace is guided through a lace lock coupled to the boot body.

7. The boot as set forth in claim 6, wherein the lace lock is coupled to the upper portion of the boot body, and wherein the lace lock is manually releasable.

8. The boot as set forth in claim 1, wherein the handpiece includes a handgrip through which a loop of the bootlace is freely guided.

9. The boot as set forth in claim 1, wherein at least one cutout is provided in the boot between the upper portion and the lower portion of the boot body, and wherein the cutout is at least one of U-shaped and V-shaped.

10. The boot as set forth in claim 1, wherein the boot includes a boot tongue extending at least over a region of the boot body covered by the lacing system, and wherein the boot tongue includes at least one of a pull tab and a pull tape for quickly opening the boot.

11. The boot as set forth in claim 1, wherein the boot includes an inner boot inserted into the boot body, and wherein the inner boot includes at least one of a pull tab and a pull tape for quickly opening the boot.

* * * * *

UNITED STATES PATENT AND TRADEMARK OFFICE

CERTIFICATE OF CORRECTION

PATENT NO. : 8,448,353 B2
APPLICATION NO. : 12/523219
DATED : May 28, 2013
INVENTOR(S) : Sven Seliger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 970 days.

Signed and Sealed this
Eighth Day of September, 2015

Michelle K. Lee

Michelle K. Lee
*Director of the United States Patent and Trademark Office*